United States Patent [19]

Lynch

[11] 4,321,927

[45] Mar. 30, 1982

[54] PACIFIER FOR NEWBORNS

[76] Inventor: Annette R. Lynch, 822 19th St., Charleston, Ill. 61920

[21] Appl. No.: 118,401

[22] Filed: Feb. 4, 1980

[51] Int. Cl.[3] ..... A61J 17/00

[52] U.S. Cl. ..... 128/360

[58] Field of Search ..... 128/359, 360

[56] References Cited

U.S. PATENT DOCUMENTS

| | | | |
|---|---|---|---|
| 722,350 | 3/1903 | Anderson | 128/360 |
| 2,520,773 | 8/1950 | Müller | 128/360 |

FOREIGN PATENT DOCUMENTS

| | | | |
|---|---|---|---|
| 530266 | 10/1957 | Belgium | 128/360 |

*Primary Examiner*—Robert W. Michell
*Assistant Examiner*—T. J. Wallen
*Attorney, Agent, or Firm*—Allegretti, Newitt, Witcoff & McAndrews

[57] ABSTRACT

A pacifier for newborns includes a substantially egg-shaped base member having a recessed portion and a relatively small nipple secured to the egg-shaped base member within the recessed portion. At least one cavity is formed in the base member opposite the recessed portion, defining finger holders for the pacifier. The base member, recessed portion and nipple cooperate to avoid blocking the newborn's nose regardless of how the pacifier is positioned in the baby's mouth and to support the baby's cheek and head so that its nose will not be smothered by a mattress, blanket or pillow.

10 Claims, 4 Drawing Figures

PACIFIER FOR NEWBORNS

BACKGROUND OF THE INVENTION

This invention relates to a pacifier for newborn babies and, more particularly, to a pacifier which avoids and helps prevent blockage of a newborn's nose when the newborn is lying unattended.

Most, if not all, commercially available pacifiers are designed for the average baby; they have a relatively large nipple attached to a safety shield that prevents the baby from swallowing the pacifier. The safety shield is a substantially disk-shaped object that may be curved along one edge to fit under the baby's nose. Such a pacifier typically has a ring-type holder attached to the safety shield opposite the nipple. See for example, Muller, U.S. Pat. No. 2,520,773; Rountree, U.S. Pat. No. 3,129,709; Guenther, U.S. Pat. No. 1,287,295; and Borchers, U.S. Pat. No. 1,372,004.

Conventional pacifiers are not designed to overcome certain problems of newborn babies, those infants aged about six weeks or less. For example, newborns do not have sufficient muscle development to control the positions of their heads. As a result, newborns can suffocate while lying in bed because their nose or air passages become blocked by a mattress, pillow or blanket. In addition, newborns have smaller mouths, making it difficult for them to retain a relatively large nipple in their mouths. In contrast to conventional pacifiers, the present invention is designed to overcome these and other problems.

GENERAL SUMMARY OF THE INVENTION

Thus, an object of the present invention is to provide a safe pacifier for newborn babies.

A further object of the present invention is to provide a pacifier that does not block the newborn's nose regardless of which way the pacifier is positioned in the newborn's mouth.

A still further object of the present invention is to provide a pacifier that provides a support for a newborn's head and cheek to keep its nose away from a mattress or pillow.

Yet another object of the present invention is to provide a more comfortable and more convenient pacifier for newborn babies. Specifically, it is an object of the present invention to provide a pacifier with a substantially solid nipple, made of flexible material and sized specifically for newborns.

The pacifier of the present invention includes an ellipsoidal, or substantially egg-shaped base member having a recessed area thereon. A nipple, sized especially for newborns, is secured to the egg-shaped base member within the recessed area. The recessed area and the nipple cooperate to define an annular recessed area between the base of the nipple and the base member.

The ellipsoidal or egg-shaped design of the base member avoids blockage of a newborn's nostrils regardless of which way the pacifier is held in the baby's mouth. The egg-shaped base member further supports the newborn's head and cheek when the infant is lying down, such that the baby's nose is kept away from pillows, mattress, and blankets, etc. and in communication with an air supply. The smaller nipple and annular recessed area help retain the pacifier in the smaller mouth of a newborn infant. Thus, the pacifier of this invention avoids blocking a newborn's nose and aids in preventing the baby from smothering while lying in bed, even though the baby's neck may be too weak to effectively control the position of its head.

DESCRIPTION OF THE DRAWINGS

In the detailed description of the preferred embodiment, reference will be made to a drawing comprised of the following figures.

DETAILED DESCRIPTION OF THE PREFERRED EMBODIMENT

Figure 1:
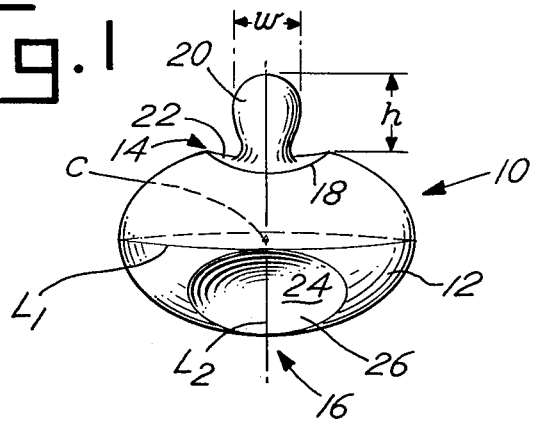
FIG. 1 is a horizontal side view of a pacifier according to the present invention.
Figure 2:
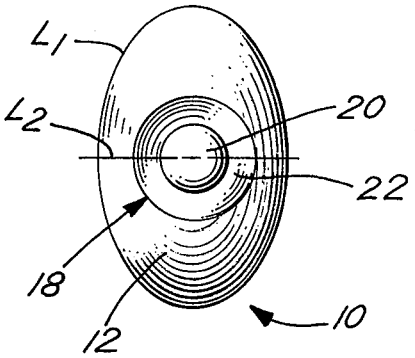
FIG. 2 is a top view of the pacifier shown in FIG. 1.

Referring initially to FIG. 1, the pacifier 10 of this invention includes a substantially egg-shaped or ellipsoidal base member 12 having an ellipsoidal center, "C". The base member 12 is preferably made of a durable, non-toxic plastic, such as polystyrene or polyethylene, which can be safely inserted in a mouth for long periods of time.

For reference purposes, since an ellipsoid has no natural top or bottom, a first area of the egg-shaped base member 12 is identified as the top 14 and a second area is identified as the bottom 16. For reference purposes, the base member shown in FIG. 1 has been marked with a longitudinal circumference, "$L_1$", defining the lengthwise dimension of the pacifier, and a latitudinal circumference, "$L_2$", defining a widthwise dimension.

A small concave depression, or recessed area 18, is formed on the base member 12 at the top 14. The recessed area 18 is preferably molded into the base member 12 when the base member 12 is formed, but may alternatively be carved into the base member 12 after the base member 12 has been formed.

A nipple 20 is secured to the base member 12 within the recessed area 18. Nipple 20 is made of a flexible, resilient and non-toxic material which can be held in the mouth for long periods of time. The nipple 20 is preferably solid so that it will not collapse if the baby sucks strongly on it for long periods of time. The nipple 20 is sized smaller than conventional nipples, being particularly designed for newborn babies and preferably having a height of between about $\frac{3}{8}$ and about $\frac{5}{8}$ inches, most preferably about $\frac{1}{2}$ inch, and a width of between about $\frac{1}{4}$ and about $\frac{1}{2}$ inches, most preferably about $\frac{3}{8}$ inch.

A portion of recessed area 18 not occupied by nipple 20 forms an annular recessed area 22 between the base of the nipple 20 and the base member 12. The annular recessed area 22 and nipple 20 cooperate to readily retain the pacifier 10 in the newborn's mouth. Retention of the pacifier is achieved, in large part, because the smaller sized nipple 20 and the annular recessed area 20 conform more closely to the shape of the newborn's own mouth and lips, allowing the baby's sucking action to comfortably maintain the pacifier in its mouth.

The egg-shaped design of base member 12 curves on all sides away from the recessed area 18 and nipple 20. As a result, the pacifier 10 of this invention does not block a baby's nostrils regardless of how the pacifier is held in the baby's mouth. Furthermore, the relatively large, egg-shaped design prevents the baby from swallowing the pacifier 10, thereby eliminating the need for a conventional safety shield.

Figure 4:
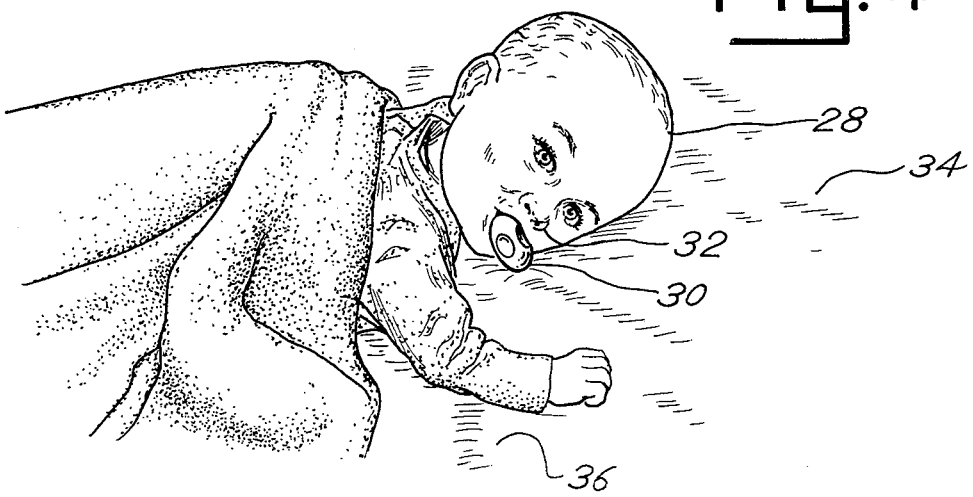
FIG. 4 is a horizontal side view showing a baby lying down with his head and cheek supported by a pacifier according to this invention.

One important aspect of this invention, best shown in FIG. 4, is that it will support a newborn's head and cheek while the baby is lying down. Even though the baby's own muscles may not be able to control or position its head, the pacifier will keep the infant's nose away from pillows and mattresses and prevent blockage of vital air passages. If a blanket becomes positioned over the newborn's head, the pacifier facilitates formation of an air pocket around the baby's nose to assist breathing.

To most effectively prevent blockage of the baby's nostrils, the pacifier is positioned in the infant's mouth with the lengthwise dimension $L_2$ oriented vertical to the ground or mattress when the baby is lying down, as shown in FIG. 4. Positioned in this manner, the pacifier maintains adequate distance between the baby's nose and obstructing material to facilitate the prevention of suffocation even when the infant is lying unattended.

Figure 3:
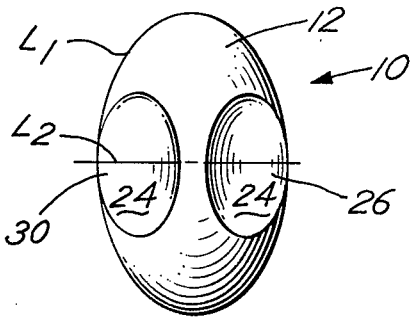
FIG. 3 is a bottom view of the pacifier shown in FIG. 1.

Referring to FIG. 1, the pacifier preferably also includes an indentation or cavity 24 in the bottom 16 of base member 12. The cavity 24 defines a holder 26 in the base member 12 at a location substantially opposite the recessed area 18. As best shown in FIG. 3, the preferred embodiment of the invention includes two cavities 24 and 28 formed substantially adajcent one another and defining holders 26 and 30, respectively, e.g., for a thumb and forefinger. These cavities 24, 28 may be carved into the egg-shaped base member 12 after it is formed or, more preferably, may be molded into the base member 12 during its formation. The holders 26, 30 thus provide a convenient means for holding the pacifier 10 and for inserting it in and withdrawing it from the newborn's mouth.

It is to be understood that the foregoing description refers to a particular embodiment of the present invention and that alternative variations and modifications are possible. Thus, the scope of this invention is to be limited only by the following claims and their equivalence.

What is claimed is:

1. A pacifier for a newborn baby, comprising, in combination:

a substantially ellipsoidal base member having a surface, a major axis and a minor axis, said major axis being greater than said minor axis;

a recessed portion located on said surface substantially concentric with said minor axis; and a nipple secured to said substantially ellipsoidal base member within said recessed portion and located substantially at the center of said recessed portion;

said nipple, said recessed portion and said substantially ellipsoidal base member defining safety support means for retaining said pacifier in a proper position within the mouth of said newborn baby and partially supporting the head of said newborn baby while avoiding and preventing blockage of said newborn baby's nose.

2. The pacifier of claim 1 wherein said nipple is sized smaller than conventional nipples, being particularly designed for newborn babies.

3. A pacifier as in claim 2 wherein said newborn baby has a mouth and lips, said nipple and said recessed portion is adapted to cooperate with said lips to maintain said pacifier in said newborn baby's mouth.

4. The pacifier of claim 2 wherein said nipple is substantially solid.

5. A pacifier as in claim 1 wherein said substantially elipsoidal base member further includes a second area being substantially opposite said first area and at least one cavity located at said second area, said cavity defining a holder for said pacifier.

6. The pacifier of claim 5 wherein said base member includes two cavities located substantially adjacent to one another at said second area to define said holder.

7. The pacifier of claim 5 wherein said elipsoidal support structure includes a top and bottom, said recessed portion being located at said top and said holder being located at said bottom.

8. The pacifier of claim 1 wherein said substantially elipsoidal base member is substantially solid.

9. The pacifier of claim 1 wherein said nipple is about $\frac{1}{2}$ inch high and about $\frac{3}{8}$ inch wide.

10. The pacifier of claim 1 wherein said major axis is about one and one-half times said minor axis.

* * * * *